US007654218B1

(12) United States Patent
Marlette

(10) Patent No.: US 7,654,218 B1
(45) Date of Patent: Feb. 2, 2010

(54) SAFETY LOCATION SIGNAL MOUNT FOR OFF ROAD USE

(76) Inventor: Aaron Marlette, 872 Lori Ct., San Marcos, CA (US) 92069

( * ) Notice: Subject to any disclaimer, the term of this patent is extended or adjusted under 35 U.S.C. 154(b) by 0 days.

(21) Appl. No.: 12/157,438

(22) Filed: Jun. 11, 2008

(51) Int. Cl.
*G09F 17/00* (2006.01)
*A41D 1/04* (2006.01)

(52) U.S. Cl. ..... 116/173; 116/209; 2/102; D11/166

(58) Field of Classification Search ..... 116/173, 116/174, 28 R; 40/586, 591; D20/19, 41, D20/42; D11/95, 165, 166, 181, 182; D2/853, D2/501; D29/122; 2/102, 310, 311
See application file for complete search history.

(56) References Cited

U.S. PATENT DOCUMENTS

D133,859 S * 9/1942 Gass ..... D11/182
3,104,644 A * 9/1963 Burton ..... 116/209
3,122,736 A * 2/1964 Weber ..... 340/815.4
3,696,334 A * 10/1972 Demeter ..... 340/432
4,035,856 A 7/1977 Oberg
D246,013 S * 10/1977 Morris et al. ..... D3/229
4,598,661 A 7/1986 Roe
5,083,956 A * 1/1992 Chraghchian et al. ..... 441/89
5,651,711 A 7/1997 Samano
5,671,480 A * 9/1997 Krout et al. ..... 2/102
5,683,020 A 11/1997 Galen et al.
5,892,445 A 4/1999 Tomich
6,749,473 B1 * 6/2004 Lower ..... 441/89
7,234,411 B1 * 6/2007 Butler ..... 116/173
2006/0021117 A1 * 2/2006 Madonia ..... 2/422
2007/0101922 A1 * 5/2007 Kengerski ..... 116/28 R

* cited by examiner

*Primary Examiner*—Amy Cohen Johnson
(74) *Attorney, Agent, or Firm*—Harpman & Harpman

(57) ABSTRACT

A mobile mounting device for location signal safety flags used by off road riders to prevent collisions when riding in hilly terrain. The mounting device of the invention provides for a flag or whip receiving mounting socket configured to be selectively attached to the back side of a chest protector worn by the off road vehicle rider. It can be moved from rider to rider.

6 Claims, 2 Drawing Sheets

SAFETY LOCATION SIGNAL MOUNT FOR OFF ROAD USE

BACKGROUND OF THE INVENTION

1. Technical Field

This device relates to safety equipment used by off road dirt bike and all terrain vehicle riders as location awareness indicators to other riders.

2. Description of Prior Art

Prior art devices of this type have been directed towards safety vests and flag holders and equipment mounts primarily on the off road equipment, see for example U.S. Pat. Nos. 4,598,661, 5,651,711, 5,683,020, 5,892,445 and 4,035,856.

U.S. Pat. Nos. 4,035,856 and 4,598,661 a water safety flag can be seen attached to a flotation vest device.

U.S. Pat. No. 5,651,711 claims a flotation vest with a flexible mast attached thereto having a color location flag thereon.

U.S. Pat. No. 5,683,020 describes a bicycle flag apparatus that can be seen having a support plate with a rotatable mount for a deployable flag on a so called fanny pack.

U.S. Pat. No. 5,892,445 is directed to a highway worker safety signal device that has a bracketed apparatus with pairs of mounted for a battery powered strobe or light fixture on an extensible mast.

SUMMARY OF THE INVENTION

An interchangeable mounting receptacle for safety location whips or flags required to be used by off road all terrain riders and vehicles. Such mounts are typically secured to the vehicle to indicate the location to other riders and to prevent collision in visibly obstructed terrain. The mounting receptacle is of a contoured configuration with location indicator mounting bore therewithin. It has a contoured surface that engages the user's safety equipment providing an angularly offset flag oriented receptacle position.

DETAILED DESCRIPTION OF THE INVENTION

Figure 1:
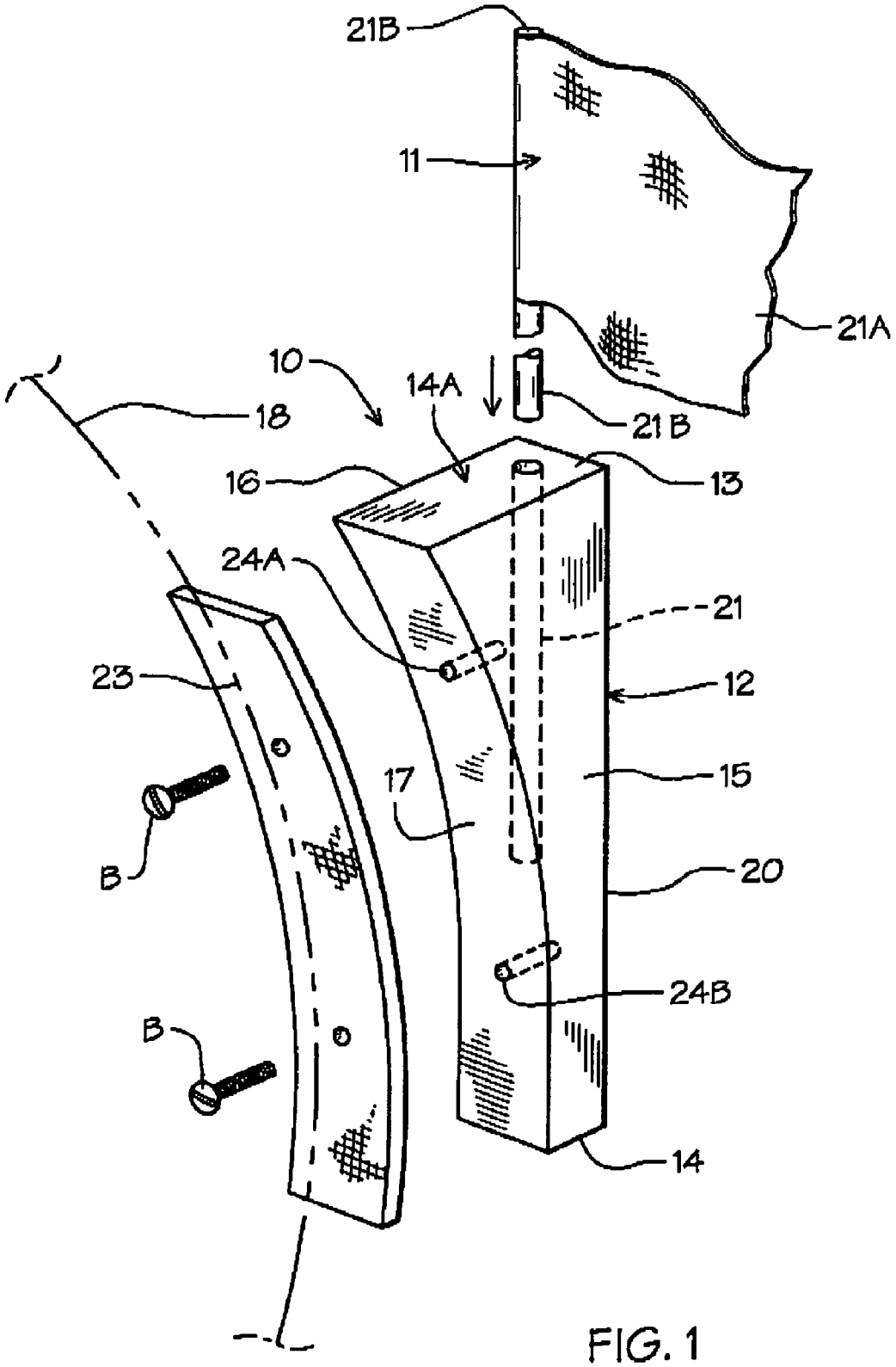
FIG. 1 is an exploded perspective view of the universal safety location flag mount for use with off road terrain vehicles.

Referring to FIG. 1 of the drawings, a safety flag mounting device 10 of the invention for location safety flags 11 can be seen having a main elongated body member 12 with a top 13 and bottom 14. The top 13 is of a generally rectangular dimension with a flat surface 14A and a depending parallel front and rear surfaces 15 and 16. The front and rear surfaces are tapered transversely and inwardly along their longitudinal extensions terminating at the bottom 14 which is of a substantially reduced portion.

Figure 2:
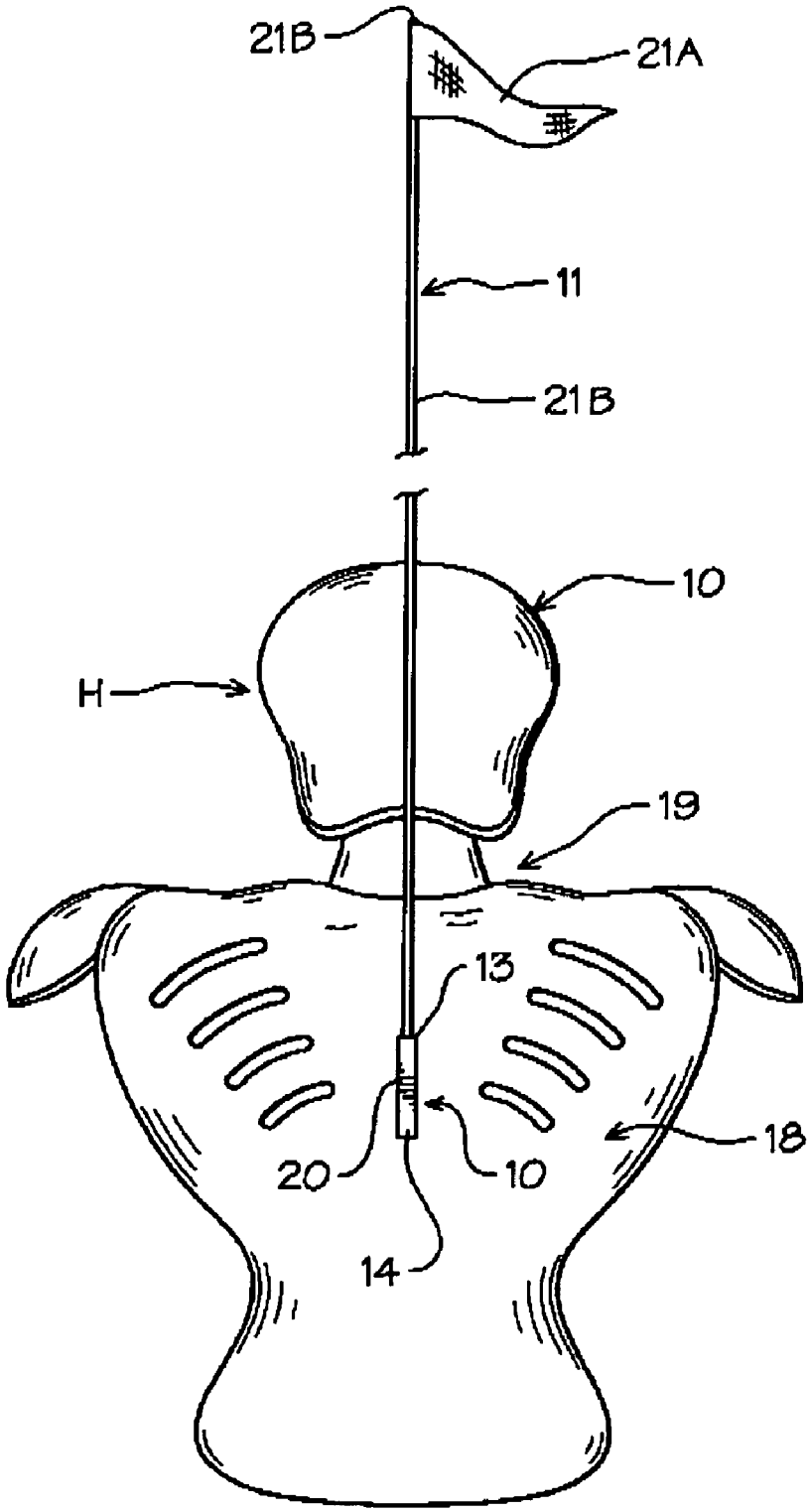
FIG. 2 is a rear perspective view of the device in use on a partial illustration of a rider's safety equipment.

Correspondingly, an end surface 17 is contoured curvilinearly along its longitudinal length which will be registerably engaged against the safety equipment 18 worn by the rider 19, best seen in FIG. 2 of the drawings.

The remaining end surface 20 extends linearly at right angles from the respective top and bottom surfaces 13 and 14 completing the structure. A safety flag 11 or safety whip receiving bore at 21 extends inwardly from the top surface 14 in spaced relation to said end surface 20. The bore 21 extends midway into the body member 12 providing a frictional engagement support for the flag 11 defining a shaft 21B and flexible warning flag element 21A positioned inwardly of its oppositely disposed end 21B which will extend a substantial distance therefrom.

A resilient neoprene mounting gasket 23 is provided between the main body member 12 and the safety equipment 18 (chest protector) which is typically made of a durable synthetic resin material for securing the mounting device 10 of the invention to the back of the rider's torso.

In use, a pair of mounting bolts B extend through the chest protector 18 indicated by a broken reference line in FIG. 1 of the drawings, the neoprene gasket 23 and are then threadably secured within corresponding aligned openings 24A and 24B in the contoured end surface 17 of the main body member 12 securing same thereto.

Use configurations of the mounting device 10 of the invention are located on safety flags 11 and corresponding location safety whips (not shown), well known in the art as seen in FIG. 2 of the drawings to be secured, as noted, on the back side of the rider's chest and torso portion. The location safety flag 11 is frictionally secured within the receiving bore 22 so by defining angular inclination thereto. This angular offset orientation of the safety flag 11 within the mounting device 10 of the invention assures that the flag 11 is in a non-interference orientation to the rider's head H as graphically illustrated in FIG. 2 for clarity only.

The mounting device 10 of the invention is preferably made of synthetic resin material and uses non-corrosive mounting bolts B to assure longevity and ease of removal, if required.

It will thus be seen that a new and novel mounting device for safety location signal flags 11 has been illustrated and described and it will be evident to those skilled in the art that various changes and modifications may be made thereto without departing from the spirit of the invention.

Therefore I claim:

1. A safety flag mounting attachment for athletic protection safety equipment used in power operated sports equipment comprises, a safety flag, a contoured flag receiving body member, a safety flag receiving opening extending into said flag receiving body member, attachment means for selectively securing said flag receiving body member to athletic protection equipment, said attachment means comprises, a mounting gasket configured to be registerably positioned on a longitudinally contoured surface curved portion of said flag receiving body member, threaded fasteners receivably secured through openings in said athletic protection equipment to aligned threaded apertures in a curved contoured surface of said flag receiving body member and said mounting gasket, said flag receiving opening extending into said flag receiving body member adjacent to and parallel with an opposing elongated straight surface of said flag receiving body member.

2. The safety flag mounting attachment set forth in claim 1 wherein said athletic protection safety equipment comprises, an upper torso chest protector.

3. The safety flag mounting attachment set forth in claim 1 wherein said safety flag comprises, a straight elongated cross-sectionally solid flag support shaft and a flag element positioned thereon.

4. The safety mounting attachment set forth in claim 3 wherein said support shaft is flexible.

5. The safety flag mounting attachment set forth in claim 1 wherein said contoured flag receiving body member being particularly characterized in that it is of a rigid synthetic resin material.

6. The safety flag mounting attachment set forth in claim 1 wherein said mounting gasket is preferably made of a resilient deformable synthetic resin material.

* * * * *